US006425716B1

(12) United States Patent
Cook

(10) Patent No.: US 6,425,716 B1
(45) **Date of Patent: *Jul. 30, 2002**

(54) HEAVY METAL BURR TOOL

(76) Inventor: Harold D. Cook, 33642 Via Martos, Dana Point, CA (US) 92629

( * ) Notice: Subject to any disclaimer, the term of this patent is extended or adjusted under 35 U.S.C. 154(b) by 0 days.

This patent is subject to a terminal disclaimer.

(21) Appl. No.: 09/548,830

(22) Filed: Apr. 13, 2000

(51) Int. Cl.[7] ..... B23B 27/20

(52) U.S. Cl. ..... 408/145; 409/231; 409/234; 451/540

(58) Field of Search ..... 409/231–234, 409/136, 131, 132; 76/108.1, 108.6; 279/158, 9.1, 102, 103, 4.06, 20, 4.01, 906, 145, 104; 408/239 R, 240, 145; 29/447, 508, 517, 446, 525, 506

(56) References Cited

U.S. PATENT DOCUMENTS

| | | | |
|---|---|---|---|
| 1,285,589 | A | 11/1918 | Barnes |
| 1,404,016 | A | 1/1922 | Engelbrekt |
| 1,409,753 | A | 3/1922 | Moore |
| 1,539,413 | A | 5/1925 | Fish |
| 1,658,504 | A | 2/1928 | Weiss |
| 1,936,498 | A | 11/1933 | Corbett |
| 1,994,792 | A | 3/1935 | Sanderson |
| 2,125,005 | A | 7/1938 | Jearum |
| 2,161,062 | A | 6/1939 | Killgore |
| 2,374,919 | A | 5/1945 | Bruseth |
| 2,729,458 | A | 1/1956 | Sacrey |
| 2,860,547 | A | 11/1958 | Stephan |
| 2,893,291 | A | 7/1959 | Hollis |
| 2,913,935 | A | 11/1959 | Flannery |
| 2,918,290 | A | 12/1959 | Werstein |
| 2,920,913 | A | 1/1960 | Antila |
| 2,942,891 | A | 6/1960 | Zale |
| 3,053,118 | A | 9/1962 | Lavallee |
| 3,221,404 | A | 12/1965 | Averill |
| 3,307,243 | A | 3/1967 | Andreasson |
| 3,372,951 | A | 3/1968 | McCash |
| 3,397,615 | A | 8/1968 | Meinke |

(List continued on next page.)

FOREIGN PATENT DOCUMENTS

| | | |
|---|---|---|
| DE | 662704 | 6/1938 |
| DE | 2229374 | 1/1974 |
| DE | 2759007 | 8/1978 |
| DE | 2811977 | 9/1979 |
| DE | 3925641 C2 | 9/1992 |
| EP | 0026751 | 11/1981 |
| EP | 382079 B1 | 8/1993 |
| GB | 551065 | 2/1942 |
| GB | 921522 | 3/1953 |
| GB | 729295 | 5/1955 |
| GB | 1319200 | 5/1973 |
| GB | 2137124 A | 10/1984 |
| JP | 5316976 | 2/1978 |
| JP | 57107710 | 6/1984 |

OTHER PUBLICATIONS

MI–Tech Metals, Inc., "High Density Tungsten Based Metals"—4 pages.

*Primary Examiner*—M. Rachuba
(74) *Attorney, Agent, or Firm*—Stetina Brunda Garred & Brucker

(57) ABSTRACT

A burr tool for use with heat shrink tool holders and fittings. The tool comprises a shank fabricated from a heavy metal material. Secured to the shank through a high temperature deposition process is an abrasive material. The shank is constructed out of a heavy metal such that the shank maintains a selected diameter within a prescribed range despite being heated to a temperature necessary for deposition of the abrasive material thereupon. As such, the shank maintains tolerances necessary for the use thereof with heat shrink tool holders and fittings.

8 Claims, 1 Drawing Sheet

U.S. PATENT DOCUMENTS

| | | | | | |
|---|---|---|---|---|---|
| 3,424,055 | A | | 1/1969 | Rollat | |
| 3,557,419 | A | | 1/1971 | Flannery | |
| 3,734,515 | A | | 5/1973 | Dudek | |
| 3,807,804 | A | | 4/1974 | Kniff | |
| 3,937,587 | A | | 2/1976 | Lindem | |
| 3,945,752 | A | | 3/1976 | Bennett | |
| 3,989,260 | A | | 11/1976 | Zonkov | |
| 3,994,615 | A | | 11/1976 | Narang | |
| 4,021,051 | A | | 5/1977 | Toyomoto | |
| 4,099,889 | A | | 7/1978 | Vig | |
| 4,133,545 | A | | 1/1979 | Komori | |
| 4,226,562 | A | | 10/1980 | Schmid | |
| 4,251,113 | A | | 2/1981 | Mitin | |
| 4,274,774 | A | | 6/1981 | Haga | |
| 4,453,775 | A | | 6/1984 | Clemmow | |
| 4,534,773 | A | | 8/1985 | Phaal | |
| 4,619,564 | A | | 10/1986 | Jacobson | |
| 4,668,138 | A | | 5/1987 | Carter | |
| 4,795,292 | A | | 1/1989 | Dye | |
| 4,808,049 | A | | 2/1989 | Cook | |
| 4,818,161 | A | | 4/1989 | Cook | |
| 4,934,743 | A | | 6/1990 | Kapgan | |
| 4,971,491 | A | | 11/1990 | Cook | |
| 5,048,375 | A | | 9/1991 | Kobayashi | |
| 5,123,217 | A | * | 6/1992 | Ishikawa et al. | 451/541 |
| 5,209,613 | A | | 5/1993 | Nishio | |
| 5,277,435 | A | | 1/1994 | Kramer | |
| 5,280,671 | A | | 1/1994 | Marquart | |
| 5,311,654 | A | | 5/1994 | Cook | |
| 5,582,494 | A | | 12/1996 | Cook | |
| 5,603,070 | A | | 2/1997 | Cerutti | |
| 5,683,386 | A | * | 11/1997 | Ellman et al. | 606/41 |
| 5,701,578 | A | | 12/1997 | Liu | |

* cited by examiner

HEAVY METAL BURR TOOL

FIELD OF THE INVENTION

The present invention relates generally to machine tools, and more particularly to a cutting tool fabricated from a heavy metal material for use with heat shrink fittings.

BACKGROUND OF THE INVENTION

As is well known, various tool holders have been utilized in the prior art which interface with a rotating spindle of a machine, such as a milling or boring machine, to securely hold a cutting tool upon the machine during the cutting of a work piece. In most prior art tool holders, a central opening is formed therein for receiving the shank portion of the cutting tool which is to be interfaced to the milling or other machine. Subsequent to the insertion of the shank portion of the cutting tool into the central opening, the tool holder is drawn or pulled tightly into the spindle so as to rigidly maintain the cutting tool within the tool holder.

However, prior art tool holders suffer from deficiencies related to the manner in which the shank portion of the cutting tool is secured within the central opening of the tool holder, with such deficiencies often resulting in non-concentric mounting of the cutting tool within the tool holder. Such non-concentric mounting is extremely undesirable, particularly in modern, high tolerance machining applications such as those performed on a vertical milling machine wherein minor variations in the concentricity of the cutting tool within the tool holder often times results in extreme flaws in the cutting operation. Additionally, prior art tool holders suffer from imbalances often associated with the mounting method of the tool in the tool holder thereby resulting in undesirable oscillations of the cutting tool upon the workpiece.

Recently, heat shrink tool holders have gained popularity in high tolerance machining applications for their ability to mount a cutting tool concentrically within the tool holder. In such holders, the central opening is sized slightly smaller than the diameter of the shank of the cutting tool. The cutting tool is only insertable into the central opening when the tool holder has been heated to a temperature necessary to expand the central opening to a size which can accept the cutting tool shank. Subsequent to the insertion of the shank thereinto, the central opening is allowed to cool to ambient temperature, thereby thermally contracting and rigidly maintaining the cutting tool shank within the tool holder. When using a heat shrink tool holder, it is necessary that the shank of the cutting tool be machined to exacting tolerances to enable retention within the central opening of the tool holder.

In certain machining applications, it is necessary to use diamond or carbide burr cutting tools which exhibit aggressive cutting properties and therefore are ideally suited for machining very strong metals and composite materials. Such cutting tools typically comprise a shank which is made of tool steel and includes a cutting head consisting of diamond or carbide burr deposited on one end by a very high temperature deposition process. However, this high temperature deposition process can change the thermal characteristics of the tool steel shank and alter its diameter such that it is not maintained within the exacting tolerances necessary for use with heat shrink tool holders and fittings. Therefore, in order to use a conventional diamond/carbide burr cutting tool with a heat shrink tool holder, the shank typically needs to be machined to the correct diameter after deposition of the diamond or carbide burr due to the high temperature deposition process changing the diameter of the shank and/or creating inconsistencies therein. This follow-up machining is an expensive and time consuming process which is not preferred.

The present invention addresses the deficiencies in prior art cutting tools by providing a carbide/diamond burr cutting tool that is fabricated from a heavy metal material such that the use of a high heat deposition process in relation thereto will not affect the dimensions of the tool shank, thus allowing the cutting tool to be used with heat shrink fittings and tool holders without conducting secondary machining and/or grinding operations during the fabrication process.

SUMMARY OF THE INVENTION

In accordance with the present invention, there is provided a cutting tool for use with a heat shrink tool holder or fitting. The cutting tool comprises a generally cylindrical shank which is of a selected diameter and is fabricated from a heavy metal material. Preferred heavy metal materials include, but are not necessarily limited to, tungsten, tungsten carbide, or a tungsten alloy. The heavy metal material from which the shank is preferably fabricated is capable of maintaining the selected diameter to within about 0.0003 inches despite being subjected to extremely high temperatures and subsequently cooled.

The present cutting tool further comprises an abrasive material which is secured to a portion of the shank, and more particularly to one end of the shank. The abrasive material is preferably a diamond or carbide burr, with the process of securing the abrasive material to the shank being accomplished by heating the shank to a prescribed temperature which is typically extremely high. Advantageously, the fabrication of the shank from the heavy metal material effectively maintains the diameter thereof within a prescribed range despite the heating of the shank to the prescribed temperature during the process of securing the abrasive material thereto.

The cutting tool of the present invention may be used in combination with a heat shrink tool holder or fitting which is fabricated from a thermally expandable material and includes a central opening sized to have a diameter slightly smaller than the diameter of the shank which is The heavy metal material of the shank has a coefficient of thermal expansion substantially less than that of the thermally expandable material of the heat shrink tool holder or fitting. The application of a heat source to the heat shrink tool holder or fitting facilitates the thermal expansion of the diameter of the central opening, thus allowing the shank to be slidably inserted thereinto. Subsequent to the slidable insertion of the shank into the enlarged central opening, the heat shrink tool holder or fitting is cooled to ambient temperature thereby facilitating the thermal contraction thereof (i.e., a reduction in the diameter of the central opening) about the shank of the cutting tool, thus rigidly securing the cutting tool within the heat shrink tool holder or fitting. Due to the coefficient of thermal expansion of the heavy metal material from which the shank is fabricated being substantially less than that of the thermally expandable material of the heat shrink tool holder or fitting, the reapplication of heat to the heat shrink tool holder or fitting facilitates the re-expansion of the diameter of the central opening without expanding the diameter of the shank, thus allowing the shank to be easily removed from therewithin.

Further in accordance with the present invention, there is provided a method for securing a cutting tool such as a burr tool to a heat shrink tool holder which is fabricated from a thermally expandable material and includes a circularly configured central opening. The method comprises the initial step of providing a tool having a generally cylindrical shank which is of a selected diameter that is slightly larger than the diameter of the central opening of the heat shrink tool holder, and is fabricated from a heavy metal material having a coefficient of thermal expansion substantially less than that of the thermally expandable material of the heat shrink tool holder. Thereafter, the heat shrink tool holder is heated so as to facilitate the thermal expansion of the central opening to a diameter whereby the shank of the tool is slidably insertable thereinto. The shank of the tool is then inserted into the central opening, with the heat shrink tool holder then being cooled to ambient temperature. Such cooling facilitates the thermal contraction of the heat shrink tool holder about the shank, thus rigidly securing the tool to the tool holder. The tool is removable from the heat shrink tool holder by reapplying heat to the tool holder whereby the central opening thermally expands and the tool is slidably removable from therewithin.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
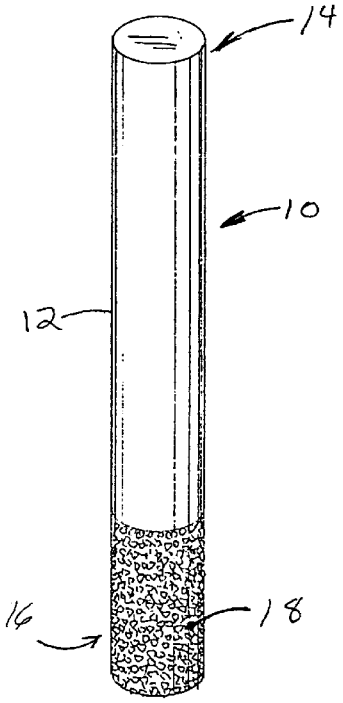
FIG. 1 is a perspective view of a burr tool constructed in accordance with the preferred embodiment of the present invention.
Figure 2:
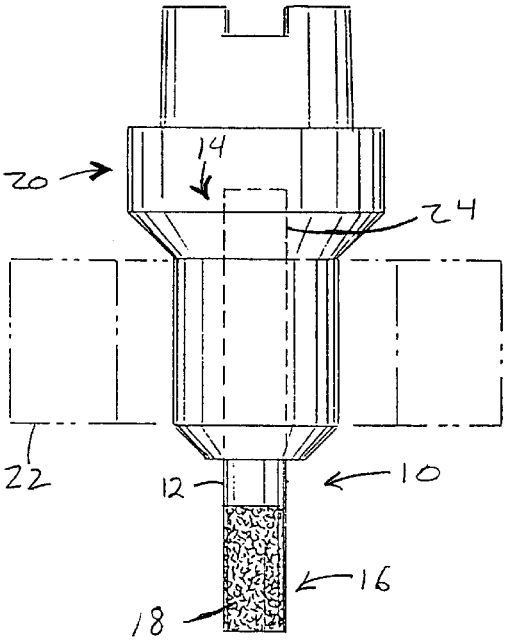
FIG. 2 is a side elevational view of the burr tool constructed in accordance with the present invention as used in conjunction with a shrink fit tool holder.

Referring now to the drawings wherein the showings are for purposes of illustrating a preferred embodiment of the present invention only, and not for purposes of limiting the same, FIG. 1 perspectively illustrates a burr tool 10 constructed in accordance with the preferred embodiment of the present invention. The burr tool 10 of the present invention finds particular utility for use in relation to a heat shrink tool holder 20 as shown in FIG. 2 or a heat shrink fitting. Exemplary heat shrink tool holders with which the burr tool 10 may be utilized are disclosed in Applicant's U.S. Pat. Nos. 5,311,654 and 5,582,494, the disclosures of which are incorporated herein by reference. However, those of ordinary skill in the art will recognize that the burr tool 10 may be used in conjunction with tool holders and fittings other than for those of the heat shrink variety.

The burr tool 10 of the preferred embodiment comprises a shank 12 fabricated from a heavy metal material. The heavy metal is characterized by its ability to remain dimensionally stable after being subjected to high temperatures. Tungsten, tungsten carbide, or tungsten alloys are well suited as materials for the shank 12 because they can maintain the diameter of shank 12 to within a range of about 0.0003 to 0.001 inches after being subjected to extreme temperatures. The importance of maintaining the diameter of the shank 12 within a prescribed range will be discussed in more detail below.

In the preferred embodiment of the present invention, the shank 12 is a solid, generally elongate cylinder with a mounting end 14 and a working end 16. The mounting end 14 is insertable into the circular opening of either a conventional or heat shrink tool holder of a milling or boring machine as will be further explained below, while the working end 16 is used for grinding or machining a workpiece. As such, the working end 16 does not necessarily need to be cylindrical but can be of any shape currently known which can grind or cut a workpiece.

As seen in FIG. 1, secured to working end 16 on a portion of shank 12 is burr 18. The burr 18 may be either a carbide burr, diamond burr or any other abrasive material suitable for machining operations and is secured to shank 12 using any high temperature deposition process that is currently known in the art whereby shank 12 is heated to a prescribed temperature that affixes burr 18 to shank 12. Burr 18 is typically affixed to shank 12 in a location whereat burr 18 can be used to cut or grind a workpiece. Therefore, as shown in FIGS. 1 and 2, burr 18 is located on the lower ¼ portion of shank 12. However, this is only illustrative of one possible location because burr 18 can be deposited on any location of shank 12 whereby it can be used for machining operations but does not interfere with the operation of shank 12 with heat shrink tool holder 20. Additionally, it is not necessary for burr 18 to be deposited completely around the circumference of shank 12 since it may be preferable to achieve different types of cutting surfaces for use on various materials by varying the amount of burr 18 deposited around shank 12.

FIG. 2 illustrates the burr tool 10 as secured to the heat shrink tool holder 20 in the preferred mode of operation. However, it is also possible to use burr tool 10 in conventional tool holders as well. Furthermore, it is not necessary for burr tool 10 to be inserted only in a tool holder 20. As those skilled in the art will appreciate, burr tool 10 can be inserted into any heat shrink fitting used for machining operations, such as those found on machine tool extensions and mounts. Either a convection or gas flame heat source 22 applies heat around the exterior of tool holder 20 near a circular cross-sectional central opening 24 extending axially therein. Accordingly, central opening 24, which is sized to have a diameter slightly smaller (i.e. about 0.0003 to 0.001 inches) than the diameter of shank 12, thermally expands such that the mounting end 14 of shank 12 is slidably insertable into opening 24. Subsequent to the insertion of shank 12 into the opening 24, tool holder 20 is cooled to ambient temperature thereby thermally contracting the same about shank 12 and rigidly securing shank 12 in tool holder 20. Therefore, burr tool 10 is secured to tool holder 20 by a metal to metal fit around shank 12 such that burr tool 10 is concentrically maintained within tool holder 20 and will not suffer from the imbalances inherent to conventional tool holders. In order to remove burr tool 10 from tool holder 20, heat is applied to tool holder 20 from heat source 22, thereby expanding opening 24 to a diameter greater than the diameter of shank 12 such that burr tool 10 can be easily removed from tool holder 20.

As is apparent from the foregoing, in order for the shank 12 of the burr tool 10 to be concentrically mounted within the tool holder 20, the shank 12 must be of a substantially constant and uniform diameter. Additionally, the thermal expansion and contraction characteristics of the material used to form the shank 12 must be different from the material used to form the tool holder 20 such that the shank 12 does not thermally expand along with the tool holder 20 when the heat source 22 is applied thereto as could preclude the removal of the shank 12 from within the expanded opening 24. These desired attributes of the shank 12 are satisfied from the fabrication thereof by the heavy metal material.

Since the heavy metal material from which the shank 12 is fabricated is dimensionally stable though being subjected to extremely high temperatures, the diameter of the shank 12 is maintained within an extremely tight tolerance range despite being subjected to extremely high temperatures during the process of depositing the burr 18 thereupon. As such, subsequent to the deposition process, the shank 12 need not be subjected to machining and/or grinding operations to correct its diameter ( i.e., make its diameter uniform) as a precursor to using the same in conjunction with the heat shrink tool holder 20. In this respect, in order to ensure a rigid engagement between the burr tool 10 and the heat shrink tool holder 20 (i.e., a complete metal to metal fit between the shank 12 and the heat shrink tool holder 20) and the concentric mounting of the shank 12 within the opening 24 of the heat shrink tool holder 20, it is essential that the diameter of at least that portion of the shank 12 adjacent the mounting end 14 thereof be substantially uniform.

Further, because it exhibits minimal amounts of thermal expansion when subjected to high levels of heat, the fabrication of the shank 12 from the heavy metal material does not result in any appreciable thermal expansion thereof when the heat source 22 is applied to the tool holder 20. In this respect, the coefficient of thermal expansion of the heavy metal material from which the shank 12 is fabricated is substantially less than that of the thermally expandable material from which the heat shrink tool holder 20 is fabricated. Thus, though the opening 24 of the heat shrink tool holder 20 is thermally expanded by the application of heat thereto by the heat source 22, the shank 12 does not undergo any significant amount of expansion and is thus easily removable from within the enlarged opening 24. Moreover, the heavy metal material is preferred for the shank 12 since, in high speed machining operations, it eliminates or dampens harmonic resonation of the tool 10 that is undesirable in precision machining or milling operations. Thus, the heavy metal material is ideally suited for use in the shank 12 of the burr tool 10 since the diameter of the shank 12 can be effectively maintained within a prescribed range even after being heated to the extreme temperatures necessary for the deposition of the burr 18 thereupon, and remains substantially constant during the thermal expansion of the opening 24 resulting from the application of heat to the heat shrink tool holder 20.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A tool for use with and retention by a heat shrink tool holder, the tool comprising:

a) a generally cylindrical shank fabricated of a heavy metal or a heavy metal composition substantially thermally stable to component diffusion therefrom and to dimensional change; and b) an abrasive material secured to a distal portion of the shank.

2. A tool as claimed in claim 1 wherein the heavy metal composition is a tungsten alloy.

3. A tool as claimed in claim 1 wherein the abrasive material is diamond burr.

4. A tool as claimed in claim 1 wherein the abrasive material is carbide burr.

5. A tool and heat shrink tool holder apparatus comprising:

a) a tool comprising a generally cylindrical shank having a shank diameter and fabricated of a heavy metal or a heavy metal composition substantially thermally stable to component diffusion therefrom and to dimensional change, said shank having a proximal portion for mounting within a tool holder and a distal portion having secured thereto an abrasive material; and b) a dimensionally non-thermally stable tool holder having a thermally expandable circular opening for receiving therein the proximal portion of the shank, said opening having a first diameter at ambient temperature less than the shank diameter and thermally expandable to a second diameter larger than the shank diameter.

6. An apparatus as claimed in claim 5 wherein the heavy metal composition of the tool is a tungsten alloy.

7. An apparatus as claimed in claim 5 wherein the abrasive material of the tool is diamond burr.

8. An apparatus as claimed in claim 5 wherein the abrasive material of the tool is carbide burr.

* * * * *